US005220246A

United States Patent [19]

Ide et al.

[11] Patent Number: 5,220,246

[45] Date of Patent: Jun. 15, 1993

[54] METHOD AND APPARATUS FOR TRANSMITTING INFORMATION USING ARC

[75] Inventors: Eizo Ide; Kitoshi Hashimoto; Takijiro Shimamoto; Tetsuo Horie; Yasuyuki Maehara; Toshihiko Maeda, all of Akunoura, Japan

[73] Assignee: Mitsubishi Jukogyo Kabushiki Kaisha, Tokyo, Japan

[21] Appl. No.: 565,210

[22] Filed: Aug. 8, 1990

Related U.S. Application Data

[63] Continuation of Ser. No. 328,206, Mar. 24, 1989, abandoned.

[30] Foreign Application Priority Data

| | | | |
|---|---|---|---|
| Apr. 1, 1988 | [JP] | Japan | 63-81072 |
| Jun. 24, 1988 | [JP] | Japan | 63-82893[U] |
| Sep. 8, 1988 | [JP] | Japan | 63-223528 |
| Oct. 25, 1988 | [JP] | Japan | 63-268860 |

[51] Int. Cl.[5] ..... H05B 41/44; H04R 3/00

[52] U.S. Cl. ..... 315/111.01; 315/76; 315/358; 381/111; 381/167

[58] Field of Search ..... 332/179, 185; 455/600, 455/608, 618; 315/76, 111.01, 326, 358; 381/111, 167

[56] References Cited

U.S. PATENT DOCUMENTS

| | | | |
|---|---|---|---|
| 771,917 | 10/1904 | DeMoura | 455/618 X |
| 1,718,999 | 10/1922 | Case | 455/618 X |
| 2,830,233 | 4/1958 | Halus et al. | 381/167 X |
| 3,156,826 | 11/1964 | Mutschler | 455/600 |

FOREIGN PATENT DOCUMENTS

| | | |
|---|---|---|
| 2246151 | 4/1975 | France . |
| 2559981 | 3/1985 | France . |

OTHER PUBLICATIONS

Franz J. Fransson and Erik V. Jansson: The STL-Ionophone: Transducer Properties and Construction J. Acoust. Soc. Am. vol. 58, No. 4, Oct. 1975.

G. A. Ostromov: A New Class of Electroacoustic Transducers: Gas Tranducers. Sov. Phys. Acoust 28 (2) Mar.-Apr. 1982.

Technical Poper: Un Hairt-Parleur Large Bondi a Plasama Froid, Nouvelle Revue de Son (No. 55-1982 Fra).

F. Bastien: Accoustics and Gas Discharges: applications to Loudspeakers. J. Phys. D: Appl. Phys. 20 (1987) 1547-1557.

Technical Paper: Haut-Parleur Large Bande A Plasma Froid, Nouvelle Revue de Son (No. 59-1982 FRA).

Article: "Investigation of a Plasma Loundspeacker" 1986 *IEEE* Michael S. Mazzola and G. Marshall Molen, Old Dominion Uni. Norfolk, Va.

Article: "Modeling of a dc Glow Plasma Loudspeaker", 1987 *Acoustical Soc. of America* Michael S. Mazzola and G. Marshall Molen, Old Dominon Uni, Norfolk, Va.

F. Bastien: Acoustics and Gas Discharges: Applications to Loundspeakers. J. Phys. D: Appl. Phys. 20 (1987) 1547-1557.

Technical Paper: haut-parleurs vers une ère nouvelle.

*Primary Examiner*—David Mis

[57] ABSTRACT

An information transmission method using arc and apparatus thereof are applied to a loudspeaker and the like having the function of illumination. The information transmission method is characterized in that arc current supplied to an arc generating device is modulated by a signal based on information to vibrate arc column so that at least one of audible waves, ultrasonic waves and arc light is employed to transmit the information. Arc having small mechanical inertia is employed as a sound producing device and accordingly can be used as a loudspeaker having a good frequency characteristic and large output. It can be used as a sound producing device having the function of illumination by utilizing strong light emitted from arc column.

5 Claims, 9 Drawing Sheets

| | | LUMINESCENT COLOR | WAVELENGTH (nm) OF SPECTRAL LINE |
|---|---|---|---|
| ALKALI METAL | Na | YELLOW | 589.6 , 589.0 |
| | K | LIGHT PURPLE | 768 |
| ALKALINE EARTH METAL | Ca | ORANGE RED | 622 , 422.7 |
| | Ba | GREEN | 535.4 |
| INERT GAS | He | PINK | |
| | Ar | BLUE WHITE | |

METHOD AND APPARATUS FOR TRANSMITTING INFORMATION USING ARC

This is a continuation of application Ser. No. 328,206, filed Mar. 24, 1989 abandoned.

FIELD OF THE INVENTION AND RELATED ART STATEMENT

The present invention relates to a method and an apparatus for transmitting information using an arc and applied to a loudspeaker having the function of an illuminator.

Heretofore, a method and an apparatus for transmitting information use a loudspeaker, as shown in FIG. 14. The loudspeaker utilizes mechanical vibrations generated by electromagnetic forces between current flowing through a coil 11 and a magnet 12 and transmitted to a vibrating plate 13.

A conventional loudspeaker, in order to vibrate air which constitutes a medium for voice, converts energy from the electrical system to the mechanical system. Accordingly, the frequency characteristic of the loudspeaker is substantially determined by the frequency characteristic of the mechanical system and the fidelity of the frequency versus voice output is limited. Further, since the loudspeaker uses a conical vibrating plate, the loudspeaker has a directivity in the opening direction of the conical vibrating plate. Therefore, there is a problem that a plurality of loudspeakers are required when information is transmitted by the loudspeaker 360° along a plane.

On the other hand, where an arc is utilized as light in an information transmission apparatus, the color of the light can not be changed since the arc gas is enclosed in a glass tube.

In the prior art described above, when the color of light produced with arc is to be utilized to be changed for transmission of information or illumination, there are problems as follows:

1) Since the kind of gas which seals the vicinity of the arc is not changed, the color of light is not changed and ornamental effect is small.

2) Since an arc discharge lamp enveloped in a glass tube also contains gas which is not changed, the color of light is not changed, and the information transmission effect and the ornamental effect as illumination are small.

OBJECT AND SUMMARY OF THE INVENTION

The present invention has been made in view of the above problems, and it is an object of the present invention to solve the above problems by providing a method and an apparatus of transmitting information using arc with excellent frequency characteristic and nondirectivity.

It is another object of the present invention to provide an information transmission apparatus using light of arc in which color of the light of arc is changed or is changed temporally to transmit information.

In order to achieve the above objects, the present invention is configured as in (1), (2), (3) and (4) described below:

(1) An information transmission method using arc is characterized in that arc current supplied to an arc generating device is modulated by a signal based on information to vibrate arc column so that at least one of audible waves, ultrasonic waves and arc light is employed to transmit the information.

In the present invention, in order to improve the frequency response characteristic for voice signal, an arc column having small mechanical inertia is employed to convert an electric signal to vibration of air which constitutes information medium of voice. Further, the arc column is employed to attain the nondirectivity.

In operation of the present invention, since the arc is expanded or contracted in accordance with the magnitude of current flowing in the arc column, air can be vibrated through the arc column in response with the current. That is, information such as voice can be transmitted by means of arc.

Accordingly, the present invention attains the following effects.

(a) Since arc having small mechanical inertia is employed as a sound generating device, it can be used as a loudspeaker having a good frequency characteristic.

(b) If arc current is modulated strongly, a sound generating device having a large output can be constituted.

(c) The arc column has the nondirectivity because of a circular section.

(d) Utilization of strong light generated by the arc column can constitute a sound generating device having the function of illumination.

(2) An information transmission method using arc is characterized in that when an arc current supplied to an arc generating device is modulated by a signal based on information, DC bias current of arc is changed in the range of a minimum current value or more capable of maintaining the arc in response to an amplitude of the signal current.

This invention is improvement of the first invention (1) and is to prevent extinction of the arc by the modulated arc current exceeding the zero point of current when the amplitude of the signal based on the information is large.

In operation of the invention, the bias current is changed in response to the amplitude of the signal such as, for example, voice signal, so that the bias current is equal to a minimum arc current capable of maintaining the arc when there is no signal and the bias current is increased when the amplitude of the signal is large, whereby the zero point of current is not exceeded to prevent extinction of the arc.

According to the present invention, since the bias current value is changed in response to the amplitude of the signal such as voice signal, the arc current is not reduced to the zero point or less of the arc current and the arc is not interrupted. That is, the arc current is not overmodulated. Further, since the bias current is maintained to the minimum current capable of maintaining the arc when there is no signal, an average power consumption can be reduced. In addition, the arc can be turned on and off in response to the magnitude of the signal such as voice signal.

(3) An information transmission apparatus using arc is characterized by the provision of an arc generating device having a pair of arc electrodes, a power source for supplying arc current to the arc generating device and a controller for modulating the arc current by a signal based on information, whereby arc column is vibrated by the modulated arc current so that at least one of audible waves, ultrasonic waves and arc light is employed to transmit the information.

The present invention is directed to the apparatus and operation and effects thereof are substantially identical with those of the first invention (1).

(4) An information transmission apparatus using arc is characterized by the provision of an arc generating device including a cylindrical shield nozzle having a gas inlet disposed near one end thereof, an electrode disposed along a central axis of the shield nozzle and having one end extending near the other end of the shield nozzle, an insulator peg having a side surface fitted into an upper end of the shield nozzle, an electrode holding member passing through the insulator peg and holding the other end of the electrode, and an electrode plate having a surface opposed to the electrode, a power source for supplying arc current to the arc generating device, and a luminescent color controller for supplying inert gas, alkali metal and/or alkaline earth metal to the gas inlet of the shield nozzle.

In operation of this invention, combination of predetermined kinds of inert gas (containing shield gas such as $N_2$ gas), alkali metal and/or alkaline earth metal is supplied from the controller through the gas inlet to the discharge electrodes in the arc discharging state. Elements in gases emit particular light and accordingly arc light having a predetermined color is obtained.

Thus, illumination light having various colors is produced.

Further, the controller can change the kind of the supply gas temporally so that color of light is changed temporally.

According to the present invention, the following effects are attained.

(a) By changing the kind of inert gas which shields the arc, the arc light can be utilized as illumination with large visual effect.

(b) Mixture of alkali metal and alkaline earth metal emitting particular light in inert (shield) gas can increase visual effect.

(c) Temporal change of color is obtained with large visual effect.

DETAILED DESCRIPTION OF PREFERRED EMBODIMENTS

Embodiments of the present invention are now described in detail with reference to attached drawings.

First Embodiment

Figure 1:
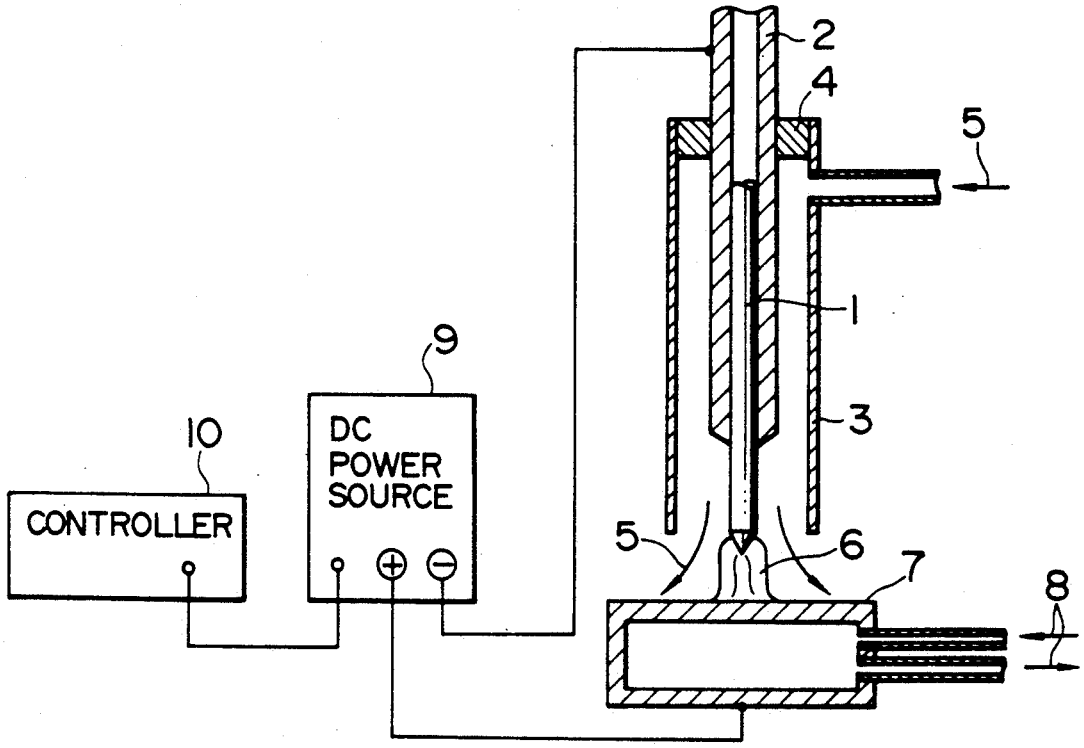
FIG. 1 is a diagram showing a configuration of an apparatus used in a first embodiment of the present invention.

FIG. 1 is a diagram showing an example of an apparatus used to implement the method of the present invention. In FIG. 1, reference numeral 1 denotes an electrode made of tungsten for generating arc 6. A copper piece 7 cooled by water 8 is an opposite electrode to the electrode 1. Reference numeral 2 denotes a collet chuck for holding the electrode 1, 3 a shield nozzle for protecting the arc 6 by shield gas 5, and 4 an insulator which holds the collet chuck 2 with respect to the shield nozzle 3 in proper place. 9 denotes a DC power source which supplies current to the arc 6 and is required to possess an excellent frequency characteristic when the high fidelity is required for information to be transmitted. 10 denotes a controller which modulates current of the DC power source 9 to produce an electric signal similar to information to be transmitted.

Operation of the embodiment is now described.

Current (arc current) modulated by small electric signal of the controller 10 is supplied to the arc 6 from the DC power source 9.

The arc 6 generated from the electrode made of tungsten is named a tungsten inert gas (TIG) arc and possess an extremely stable arc state.

Figure 2:
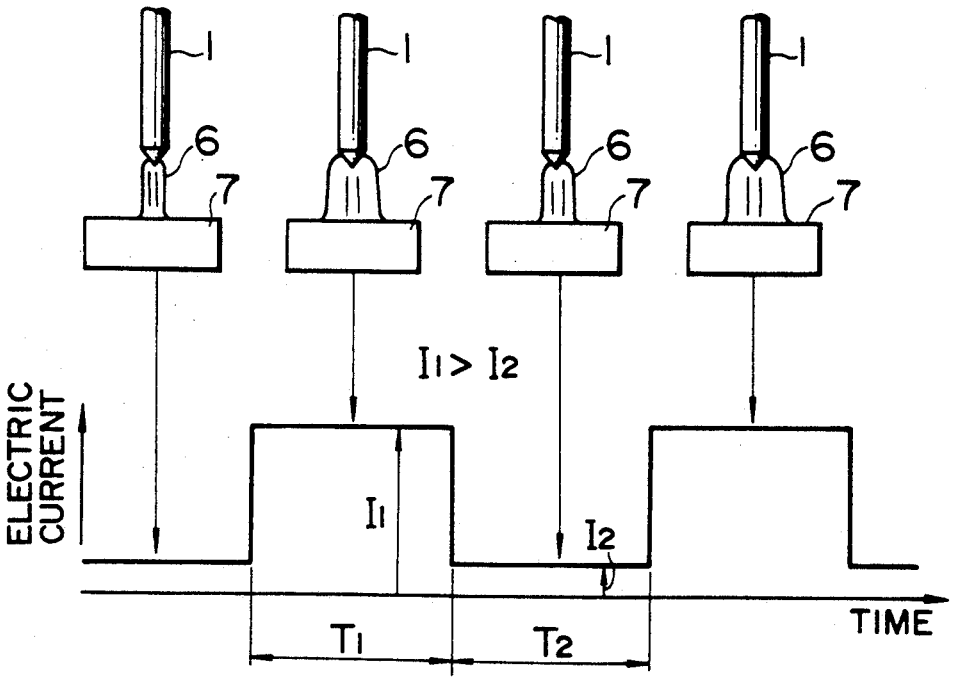
FIG. 2 is a diagram showing a correspondence relation between the magnitude of arc column and current.

As shown in FIG. 2, a sectional area of arc column is changed in accordance with the magnitude of current flowing through the arc 6. That is, the relation of the magnitude of current and the sectional area is substantially linear.

Since the arc 6 is a mixture of high temperature shield gas and plasma formed of part thereof, the arc has extremely small mechanical inertia and can response to the currents having time duration $T_1$ and $T_2$ of $10^{-1}$ msec and $10^{-1.5}$ msec, respectively.

Accordingly, the arc column can be used as a sound producing device having large output and frequency characteristic.

Further, since the arc emits strong light, it can be used as a sound producing device having the function of illumination.

Figure 3:
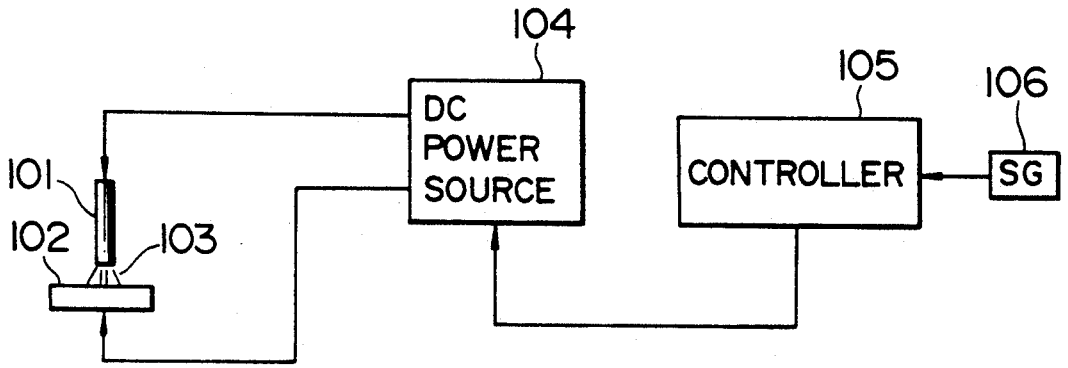
FIG. 3 is a block diagram showing an apparatus according to another embodiment in which information signal is constituted of audio signal.

FIG. 3 shows an apparatus according to another embodiment of the present invention, in which information signal to be transmitted is audio signal. That is, the apparatus modulates the DC TIG arc current with an audio current (or superposes the audio current on the DC TIG arc current) to produce sound by arc column.

In FIG. 3, 101 denotes a TIG torch, 102 a mother plate made of copper and cooled by water, 103 arc column generated between the TIG torch 101 and the mother plate 102, 104 a DC power source for TIG, 105 a controller which controls current from the power source 104, and 106 an audio signal source formed of a tape recorder, a microphone or the like.

In the configuration shown in FIG. 3, the TIG torch 101 is supplied with power from the power source 104 to generate the arc 103 between the mother plate 102 and the torch 101. An arc current at this time is a current io having a bias current value shown in FIG. 4.

Figure 4:
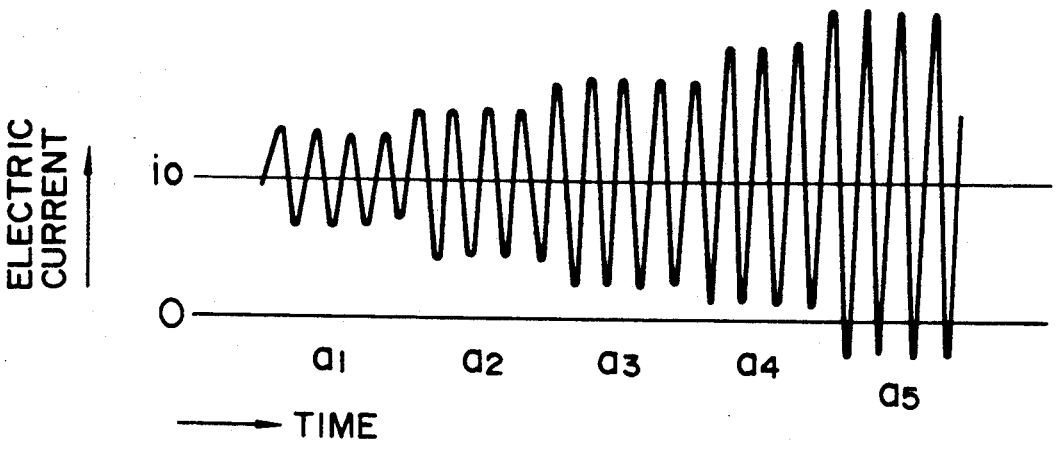
FIG. 4 is a waveform diagram of a bias current in the apparatus shown in FIG. 3.

Next, the controller 105 is applied with an audio signal from the tape recorder 106 or the like and the current from the power source 104 is modulated by an output of the controller 105. A waveform at this time is shown in FIG. 4. When the audio current is superposed on the DC fixed arc bias current in this manner, the arc current is changed in accordance with the applied audio current and the arc column 103 is vibrated correspondingly so that the vibration is propagated as sound wave to space.

In this manner, the apparatus shown in FIG. 3 can produce satisfactory sound by means of arc easily.

Second Embodiment

The apparatus of the first embodiment shown in FIG. 3 can produce satisfactory sound by means of arc easily, while there is a possibility that the arc current exceeds the current zero point to extinguish the arc when an amplitude of the current is large as shown by $a_5$ of FIG. 4 in the apparatus in which the audio current is superposed on the fixed bias current as shown in FIG. 4. In addition, the average current is not changed irrespective of the amplitude of the current and hence the efficiency is not good. Accordingly, the apparatus of FIG. 3 is improved by the second embodiment.

Figure 5:
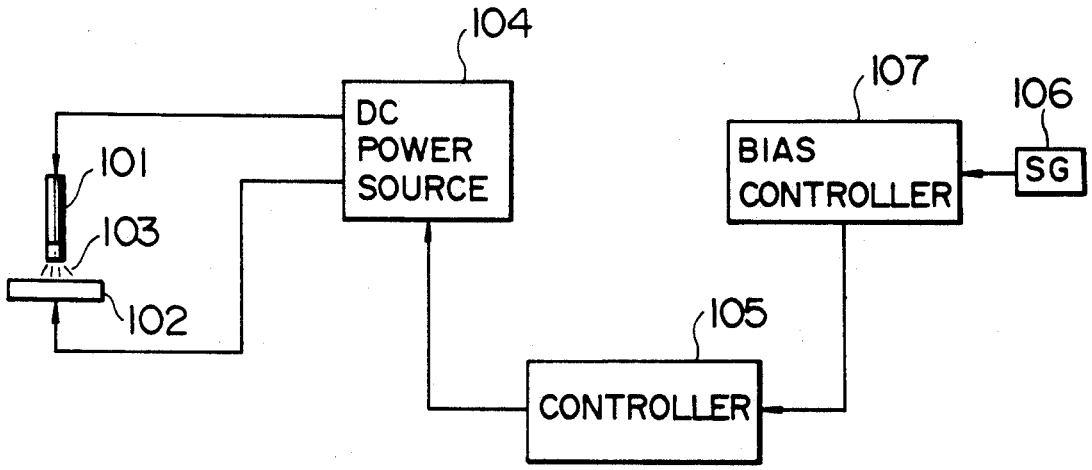
FIG. 5 is a block diagram of an apparatus used in a second embodiment of the present invention.
Figure 6:
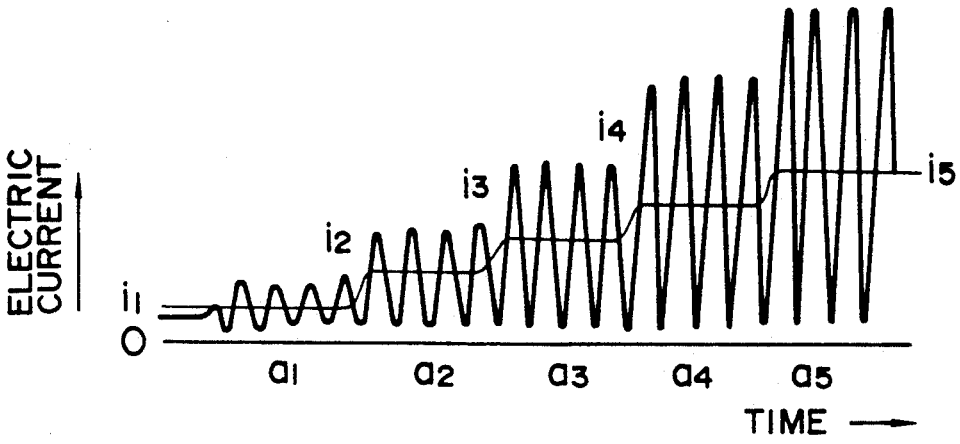
FIG. 6 is a waveform diagram of a floating bias current obtained in the embodiment of FIG. 5.

The second embodiment of the present invention is now described with reference to FIGS. 5 and 6. In FIG. 5, reference numeral 107 denotes a bias controller which changes an bias current in response to an amplitude of the audio signal. Like elements of FIG. 5 to those of FIG. 3 are designated by like numerals of FIG. 3 and description thereof is omitted.

In the configuration shown in FIG. 5, power from the power source 104 is supplied to the TIG torch 101, and arc 103 is generated between the mother plate 102 and the torch 101.

Then, an audio signal is applied to the controller 105 from the tape recorder, microphone or the like 106 to modulate current from the DC power source 104 by the output of the controller 105. The above operation until the modulation is the same as that of FIG. 3, although in the present embodiment the bias controller 107 controls the bias current to be a minimum current $i_1$ capable of maintaining the arc when there is no audio signal as shown in FIG. 6. As the amplitude is gradually increased, the bias current is changed to $i_2$, $i_3$–$i_5$ in accordance with the amplitude as shown in FIG. 6. FIG. 6 schematically illustrates the change of the bias current and the amplitude thereof is gradually increased, although the change of the bias current can follow an amplitude of a signal such as a music and voice signal having an amplitude which change suddenly.

The bias controller 107 which is the most important constituent of the present embodiment is now described in detail.

Figure 7:
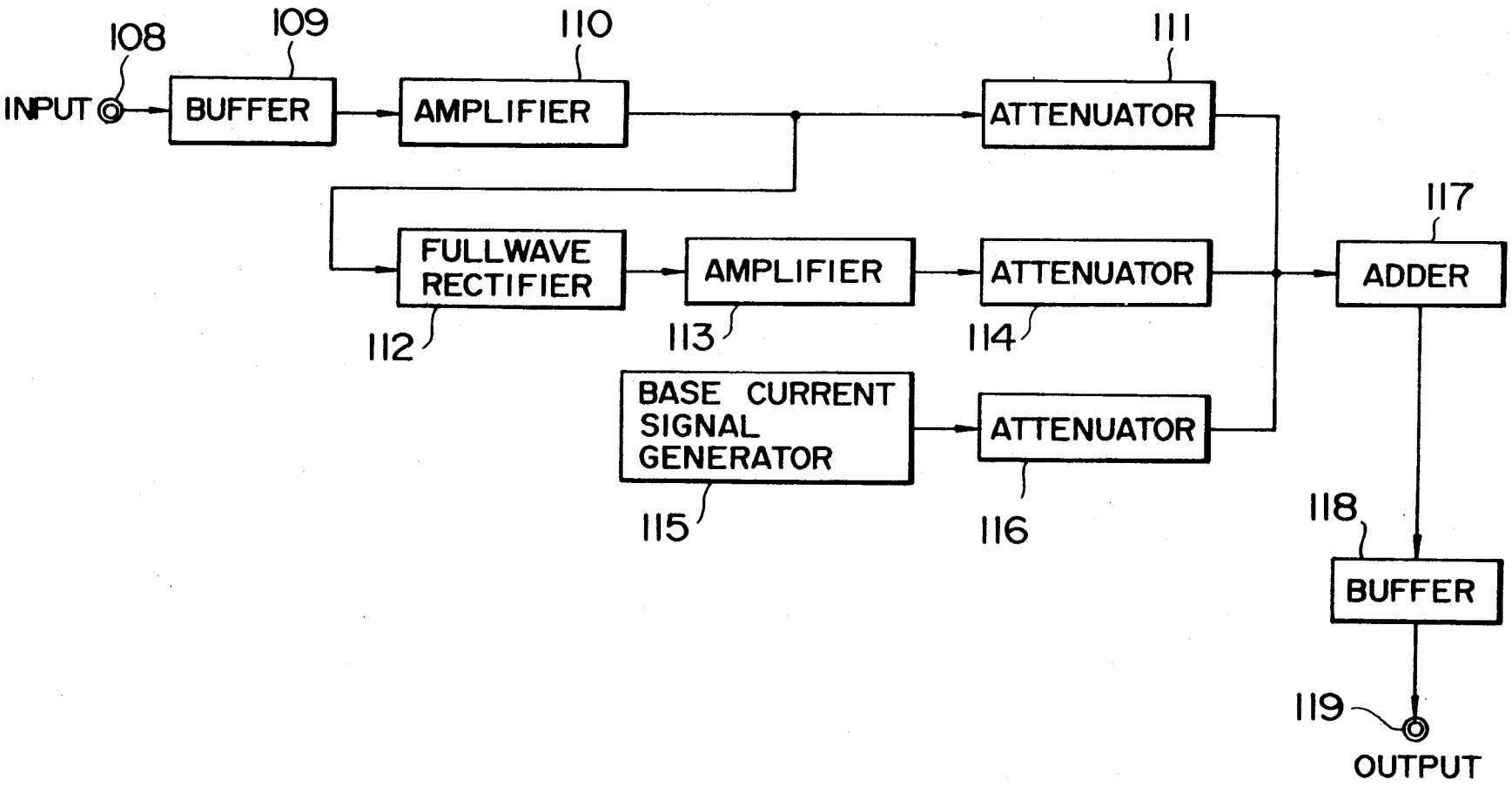
FIG. 7 is a system diagram of a bias controller used in the embodiment.

FIG. 7 is a block diagram of the bias controller 107. In FIG. 7, reference numeral 108 denotes an input terminal to which an audio signal is applied from the microphone, tape recorded or the like 106. The signal applied to the terminal is amplified by an amplifier 110 through a buffer 109 and supplied to an attenuator 111. The signal is divided into two signals and one of them is supplied to a full-wave rectifier 112 which produces a DC signal component in accordance with an amplitude thereof. The DC signal component is amplified by an amplifier 113 to a necessary extent and then supplied to an attenuator 114. At the same time, an output of a base current signal generator 115 is supplied to an attenuator 116.

Outputs produced from the attenuators 111, 114 and 116 are supplied to an adder 117 and an output of the adder 117 is produced through a buffer 118 from an output terminal 119. In this manner, the amplified audio signal, the DC signal component obtained by rectifying the amplified audio signal, that is, the DC signal component (a floating bias component) in accordance with the amplitude of the amplified audio signal, and the base current signal output for selecting the minimum bias are supplied to the adder 117 through attenuators 111, 114 and 116, respectively, to form the waveform as shown in FIG. 6.

Third Embodiment

Figure 8:
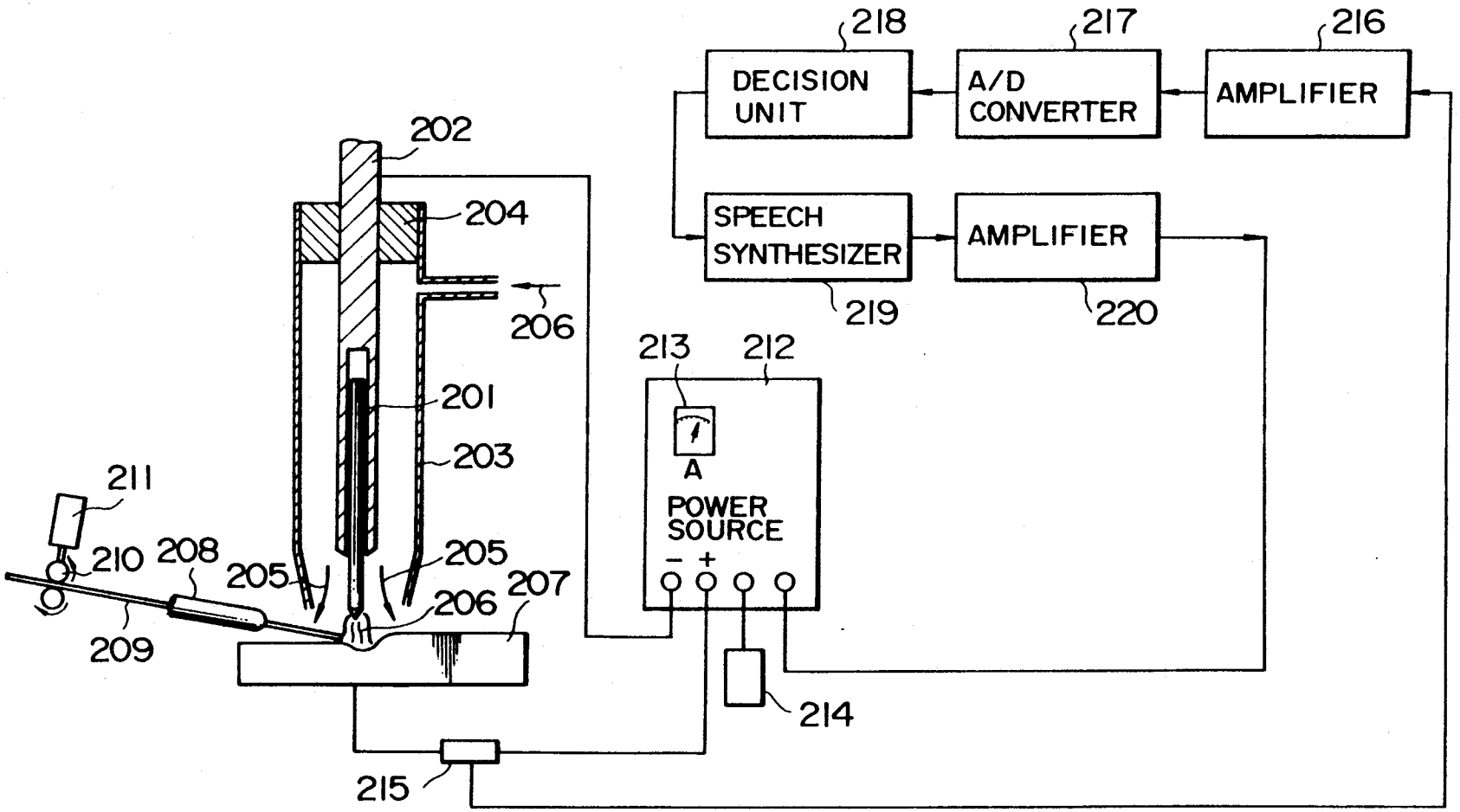
FIG. 8 is a diagram showing a configuration of an arc welding machine used in a third embodiment of the present invention.

A third embodiment of the present invention is now described with reference to drawings. FIG. 8 shows a configuration of a TIG arc welding machine. However, a MAG arc welding machine may be used instead of the TIG arc welding machine. In FIG. 8, a tungsten electrode 201 generates arc 106 between the electrode 201 and a work 207 constituting an opposite electrode. A chuck 202 holds the tungsten electrode 201 and is connected to the negative pole of a welding power source 212. A shield nozzle 203 shields the arc 206 and the vicinity thereof from air along with shield gas 205. A insulator member 204 holds the chuck 202 with respect to the shield nozzle 203 in proper place. A torch is configured as described above.

A chip 208 leads a fillet wire 209 into the arc 206 exactly. Rollers 210 serves to feed the filler wire 209 by means of a motor 211. Am ampere meter 213 of the welding power source 212 is to indicate a welding current. A setting unit 214 of the welding current and a detector 215 of the welding current are connected to the power source 212. An amplifier 216 amplifies an output signal of the detector 215 to a proper magnitude. An A-D converter 217 converts an analog output signal of the amplifier 216 to a digital signal. A decision unit 218 decides a magnitude of a detected welding current. A speech synthesizer or an audio response unit 219 converts the welding current identified by the decision unit 218 to an audio signal in accordance with the magnitude of the welding current. An amplifier 220 amplifies an analog output signal of the speech synthesizer 219 to supply the amplified signal to the welding power source 212, the signal being an audio modulation signal of the welding current.

The welding operation of the welding machine as configured above is performed in the following manner. A value of the current necessary for the welding operation is set by the setting unit 213 having a scale. An approximate value of the current can be obtained, while it is necessary to measure the current by the ampere meter 213 exactly.

On the other hand, a value of the welding current is detected by the detector 215. The detected signal by the detector 215 is amplified by the amplifier 216 to a signal having a proper amplitude.

Since the decision unit 218 using the digital signal processing is employed in order to determine an absolute value of the welding current on the basis of the signal produced from the amplifier 216, an analog signal produced from the amplifier 216 is converted to a digital signal by the A-D converter 217.

Thus, the decision unit 28 determines a value of the welding current. The value of the welding current determined by the decision unit 218 is converted to the voice signal representing that "the welding current is one hundred and fifty amperes" by the speech synthesizer 219.

Figure 9:
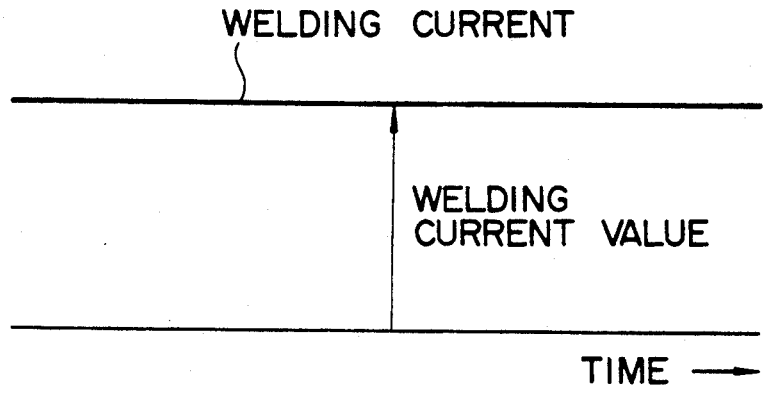
FIG. 9 is a waveform diagram of an ordinary welding current for explaining operation of FIG. 8.

The analog voice signal produced from the speech synthesizer 219 is amplified by the amplifier 220 to be supplied to the welding power source 212 so that the voice signal is superposed on the welding current set by the setting unit 214. In this case, when the voice signal is not superposed, the welding current is constant as shown in FIG. 9.

Figure 10:
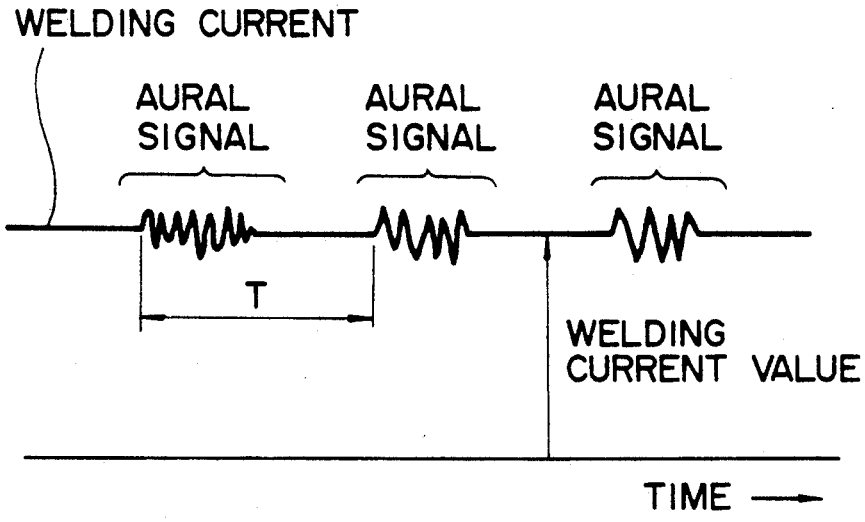
FIG. 10 is a waveform diagram of a welding current modulated by voice signal for explaining operation of FIG. 8.

FIG. 10 shows the welding current which is constant and on which the voice signal or aural signal is superposed (that is, a constant welding current modulated by the voice signal). As shown in FIG. 10, in a portion of the welding current modulated by the voice signal, the magnitude of the arc is changed in response to the voice signal to vibrate the arc so that the vibration of the arc is converted to voice which is transmitted to the ears of the welding operator.

Consequently, the welding operator can understand the magnitude of the actual welding current while performing the welding operation.

In FIG. 10, T is a modulation period of the welding current by the voice signal which is generally selected to be about 5 to 60 seconds.

In brief, in the present embodiment, since the welding current is modulated by the voice signal and the arc is vibrated by the voice signal, the voice signal can be recognized through the ears as voice.

Further, in the present embodiment, since the voice signal is combined with the welding current, the welding operator can recognize the magnitude of the welding current while continuing the welding operation.

As described above, the welding operator can understand the welding current without interrupt of the welding operation. Further, the welding operator can understand the actual welding current by the voice produced with the arc and confirm the welding current at proper intervals. Accordingly there can provide the welding current recognition method using the voice of arc in which the welding condition is always maintained properly and false operation does not occur.

Fourth Embodiment

A fourth embodiment of the present invention is now described with reference to FIGS. 11 and 12.

Figure 11:
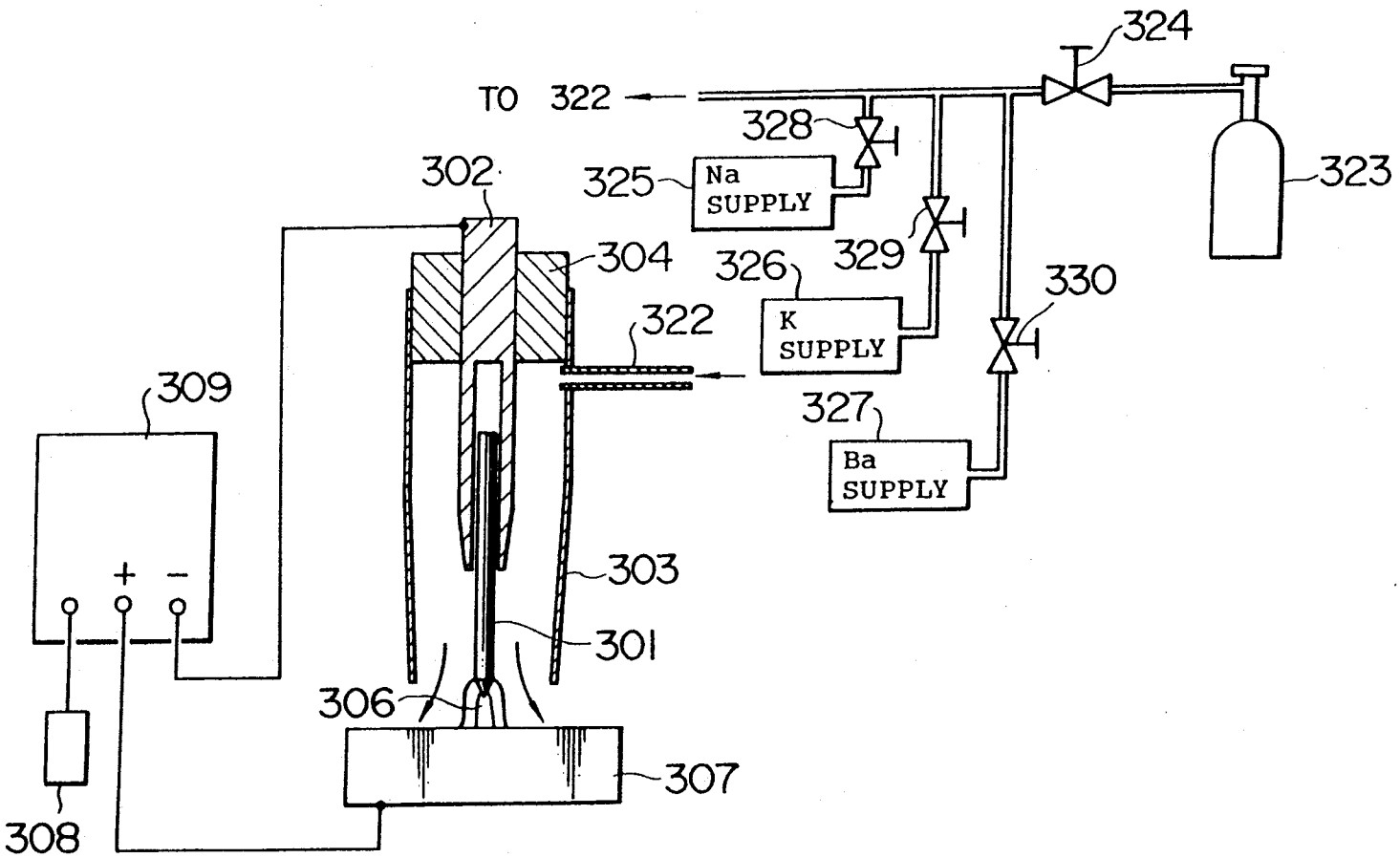
FIG. 11 is a diagram showing a configuration of an apparatus used in a fourth embodiment of the present invention.
Figures 12, 14:
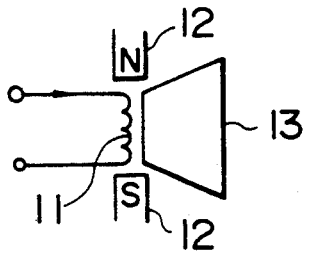
FIG. 12 shows a relation of elements and luminescent color.
FIG. 14 is a diagram showing a configuration of a conventional loudspeaker.

In FIG. 11, a shield nozzle 303 is cylindrical and includes a gas inlet 322 formed at the upper portion thereof. An insulator peg 304 is fitted into the upper end of the shield nozzle 303 hermetically. A discharge electrode 301 made of tungsten is disposed along the central axis of the shield nozzle 303 and the lower end of the discharge electrode 301 is positioned in the lower end of the shield nozzle 303. A contact chip 302 passes through the insulator peg 304 and the lower end of the contact chip 302 holds the upper end of the discharge electrode 301. An electrode plate 307 is disposed below the shield nozzle 303 so that the surface of the electrode plate is opposed to one end of the discharge electrode 301. Further, there is provided a DC power source 309 having a voltage regulator 308, and output terminals of the power source 309 are connected to the upper end of the contact chip 302 and the electrode plate 307.

Supply sources 323, 325, 326 and 327 of inert gas, alkali metal natrium, potassium and alkaline earth metal barium, respectively, are connected to the gas inlet 322 through first, second, third and fourth valves 324, 328, 329 and 327, respectively.

With the above configuration, when the first valve 324 is opened, shield gas made of inert gas enters from the gas inlet 322. Then, when a high voltage is applied between the discharge electrode 301 and the electrode plate 307, arc 306 is generated. When the fourth valve 330 is opened and gas containing Ba gas or Ba particles fed from the supply source 327 of Ba is fed from the gas inlet 322, green light peculiar to Ba is emitted in the arc discharging portion as shown in FIG. 12.

Further, when the fourth valve 330 is closed and the second valve 328 is opened to supply Na, yellow light is produced. A known controller is employed to combine the supply sources so that light having various color is produced. In addition, when the combination of the sources is changed in a predetermined pattern temporally, color of light is changed and the visible effect is improved.

Thus, a predetermined combination of inert gas, alkali metal and alkaline earth metal (one of the combination contains at least inert gas and the other contains nothing) is fed to emit light having a predetermined color.

The above supply sources include one source for inert gas, two sources for alkali metal and one source for alkaline earth metal, while other kinds of supply sources may be added.

Figure 13:
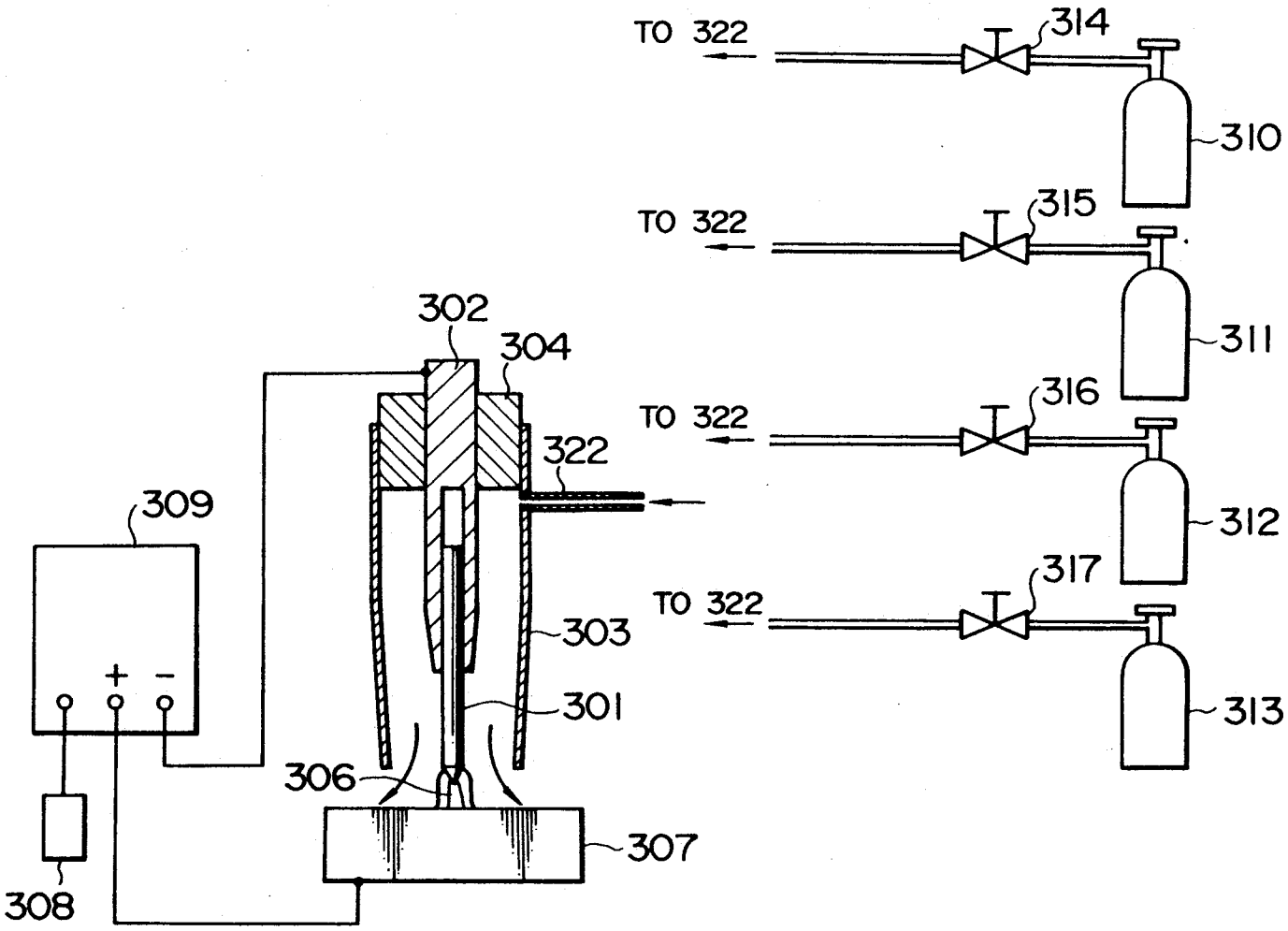
FIG. 13 is a diagram showing a configuration of another embodiment of the present invention.

FIG. 13 shows another embodiment. In FIG. 13, reference numeral 310 denotes a supply source for nitrogen gas, 311 a supply source for helium gas, 312 a supply source of argon gas, 313 a supply source for xenon gas and 314 to 317 valves for the respective sources.

We claim:

1. An information transmission apparatus, comprising an arc generating device, means for supplying arc current to said arc generating device so as to form an arc column, means for supplying inert gas to the arc column, means for modulating the arc current by a signal based on information to vibrate the generated arc column by the modulated arc current so that one of audible waves, ultrasonic waves and arc light transmits said information.

2. An information transmission method, comprising:

(a) supplying an arc current to an arc generating device shielded by inert gas so as to generate an arc column;

(b) modulating said arc current supplied by a signal based on information output from a controller;

(c) vibrating air with the arc column due to change in said arc current modulated by said signal; and (d) transmitting the information with one of audible waves, ultrasonic waves, and arc light.

3. An information transmission method as in claim 2, wherein:

(e) said modulating of said arc current by a signal based on information output from a controller includes changing a D.C. bias arc current at more than a minimum current value needed to maintain the arc by means of a bias controller and according to the amplitude of said signal current.

4. A method as in claim 2, wherein the arc column has a diameter, and the step of modulating the arc current varies the diameter and causes vibration of the surrounding air.

5. An information transmission apparatus comprising (a) an arc generating device including a cylindrical shield nozzle having a gas inlet disposed in the proximity of one end thereof, an electrode disposed along the central axis of said shield nozzle and having one end thereof extending near the other end of said shield nozzle, an insulator peg having a side surface fitted into the upper end of said shield nozzle, an electrode holding member passing through said insulator peg and holding the other end of the electrode, and an electrode plate with its surface facing the said electrode;

(b) a D.C. current source for supplying an arc current to said arc generating device so as to generate an arc column; and (c) a luminescent color controller for supplying an inert gas, or a mixture of inert gas of alkali metal and/or alkali earth metal, to said gas inlet of said shield nozzle, so that said inert gas or a gas mixture constituting the required information is supplied to generate an arc light having a given color.

* * * * *